US006392137B1

(12) United States Patent
Isvan

(10) Patent No.: US 6,392,137 B1
(45) Date of Patent: May 21, 2002

(54) POLYPHONIC GUITAR PICKUP FOR SENSING STRING VIBRATIONS IN TWO MUTUALLY PERPENDICULAR PLANES

(75) Inventor: Osman K. Isvan, Nashville, TN (US)

(73) Assignee: Gibson Guitar Corp., Nashville, TN (US)

( * ) Notice: Subject to any disclaimer, the term of this patent is extended or adjusted under 35 U.S.C. 154(b) by 0 days.

(21) Appl. No.: 09/559,569

(22) Filed: Apr. 27, 2000

(51) Int. Cl.[7] ..... G10H 3/18

(52) U.S. Cl. ..... 84/726
(58) Field of Search ..... 84/725–728

(56) References Cited

U.S. PATENT DOCUMENTS

| | | | | |
|---|---|---|---|---|
| 2,968,204 | A | | 1/1961 | Fender |
| 3,066,567 | A | | 12/1962 | Kelley, Jr. |
| 3,073,202 | A | | 1/1963 | Evans |
| 3,073,203 | A | | 1/1963 | Evans |
| 3,080,785 | A | | 3/1963 | Evans |
| 3,249,677 | A | | 5/1966 | Burns et al. |
| 3,453,920 | A | | 7/1969 | Scherer |
| 3,530,228 | A | | 9/1970 | Scherer |
| 3,539,700 | A | | 11/1970 | Johnson |
| 3,571,483 | A | | 3/1971 | Davidson |
| 3,712,951 | A | | 1/1973 | Rickard |
| 3,983,778 | A | | 10/1976 | Bartolini |
| 4,026,178 | A | | 5/1977 | Fuller |
| 4,160,401 | A | | 7/1979 | Tomioka |
| 4,182,213 | A | | 1/1980 | Iodice |
| 4,189,969 | A | | 2/1980 | Katayama et al. |
| 4,211,139 | A | | 7/1980 | Murakami |
| 4,236,433 | A | | 12/1980 | Holland |
| 4,248,120 | A | | 2/1981 | Dickson |
| 4,348,930 | A | * | 9/1982 | Chobanian et al. ..... 84/726 |
| 4,378,721 | A | | 4/1983 | Kaneko et al. |
| 4,378,722 | A | | 4/1983 | Isakson |
| 4,450,744 | A | | 5/1984 | Shubb |
| 4,535,668 | A | | 8/1985 | Schaller |
| 4,624,172 | A | * | 11/1986 | McDougall ..... 84/726 |
| 4,686,881 | A | | 8/1987 | Fender |
| 4,860,625 | A | | 8/1989 | Mathews |
| 4,867,027 | A | | 9/1989 | Barbera |
| 4,911,054 | A | | 3/1990 | McClish |
| 5,078,041 | A | | 1/1992 | Schmued |
| 5,109,747 | A | | 5/1992 | Spuler |
| 5,148,733 | A | | 9/1992 | Beller |
| 5,153,363 | A | | 10/1992 | Fishman et al. |
| 5,155,285 | A | | 10/1992 | Fishman |
| 5,204,487 | A | | 4/1993 | Turner |
| 5,223,660 | A | | 6/1993 | Wahlgreen |
| 5,233,123 | A | * | 8/1993 | Rose et al. ..... 84/726 |
| 5,237,126 | A | | 8/1993 | Curtis et al. |
| 5,322,969 | A | | 6/1994 | Aaroe et al. |
| 5,354,949 | A | | 10/1994 | Zwaan |
| 5,399,802 | A | | 3/1995 | Blucher |
| 5,410,101 | A | | 4/1995 | Sakurai |

(List continued on next page.)

*Primary Examiner*—Jeffrey Donels
(74) *Attorney, Agent, or Firm*—Waddy & Patterson; Lucian Wayne Beavers

(57) ABSTRACT

A transducer for detecting vibrations in an object. Multiple pickup coils are utilized which are sensitive to both the vibrations in the string plane and the vibrations perpendicular to the string plane. This system subtracts the signals from the first and second pickups to create a signal representing the vibrations in the string plane and combines the signals from the first pickup and the second pickup for determining the string vibrations perpendicular to the string plane. In one embodiment of the invention, the transducer uses one pole of the pickup as a bridge saddle for supporting the guitar string. The saddle pole of the pickup is constructed from a magnetically permeable material. The saddle pole causes the lines of magnetic flux to be carried in large part by the guitar string and allows for a reduction in the total magnetic energy requirement for the pickup's permanent magnet to reduce the cross talk between adjacent string sensors within a polyphonic pickup.

26 Claims, 5 Drawing Sheets

U.S. PATENT DOCUMENTS 5,455,381 A 10/1995 Juszkiewicz et al.
5,463,185 A 10/1995 Fishman
5,525,750 A * 6/1996 Beller ..... 84/726
5,530,199 A 6/1996 Blucher
5,539,147 A 7/1996 Hoshino
5,602,353 A 2/1997 Juszkiewicz et al.
5,610,357 A * 3/1997 Frank-Braun
5,668,520 A 9/1997 Kinman
5,670,733 A 9/1997 Fishman
5,723,805 A 3/1998 Lacombe

* cited by examiner

POLYPHONIC GUITAR PICKUP FOR SENSING STRING VIBRATIONS IN TWO MUTUALLY PERPENDICULAR PLANES

BACKGROUND OF THE INVENTION

The present invention is directed towards transducers. These devices are used to convert the physical energy of a vibrating ferromagnetic object into an electrical signal. The pickup of an electric guitar is a transducer that converts the kinetic energy of a vibrating guitar string into an electrical signal in the form of an oscillating voltage. Generally, guitar pickup transducers utilize permanent magnets and electrical coils that are formed by winding insulated copper wire around pole pieces. The transducer's magnet and coil winding system are mounted on the body of a guitar so that the guitar strings pass through the magnet's flux field and alter the shape of the magnetic field when the string vibrates. The changing flux induces an electrical signal in the windings of the pickup. The guitar amplifier converts this voltage into sound.

The traditional guitar has a plurality of guitar strings that are secured at each end and held under tension to vibrate at the appropriate frequency. The guitar strings are supported on a bridge over a transducer. On electric guitars with magnetic pickups, the guitar strings normally do not touch the pickup/transducer, but instead lie in close proximity thereto. This is also the case for tone-hole pickups used in acoustic guitars. The transducer includes a magnet that emits a magnetic field and an electrical coil that is placed within the effects of the magnet field. The strings are constructed from magnetically permeable material and are placed so that they pass through the transducer's magnetic field. When plucked or strummed, the magnetically permeable material of the vibrating guitar strings produce a corresponding oscillating magnetic flux at the windings of the coil. Thus, through magnetic induction, the vibration of the guitar strings moving within the lines of magnetic flux emanating from the pickup causes an electrical signal to be generated within the coil of the pickup.

Often, during music performance or recording, the pickup signal is processed to create a desired effect. Among the most common effects are added harmonic distortion, chorus and reverberation. For some of the more sophisticated effects, such as polyphonic fuzz, it is preferred, and sometimes required, that a separate signal be obtained from each string. For this purpose, polyphonic pickups are used. A polyphonic pickup contains multiple sensors, each one being particularly sensitive to the vibrations of one string and relatively insensitive to the vibrations of other strings. A polyphonic pickup for a six-string guitar has six sensors, and is sometimes referred to as a hexaphonic pickup or a hex pickup. Polyphonic or hexaphonic guitar pickups are also used in systems where the guitar is interfaced with a digital signal processor or synthesizer where the final sound is created.

In a hexaphonic pickup, each sensor is dedicated to a different string of a six-string guitar. The two common types of pickups used for this purpose are piezoelectric and magnetic pickups. The magnetic pickup generally consists of variable reluctance type magnetic field sensors with permanent magnets and sensor coils located under the strings. This type of pickup produces output voltages in its coils in response to the velocity of the vibration of the parts of the strings that are in its magnetic field.

Variable reluctance type transducers are often used to measure or detect the velocity of a moving ferromagnetic target. When the target can move only along a predetermined path, the direction of velocity can be determined from the polarity of the voltage induced at the sensing coil of the transducer. However, if the target can move along an arbitrary path, as in the case of a section of a vibrating guitar string, the direction of movement cannot be determined from the induced voltage polarity, nor does the magnitude of the induced voltage accurately represent the magnitude of the target's velocity.

As previously noted, polyphonic guitar pickups are often used in combination with signal processors that are designed to create different sounds depending on certain characteristics of string vibrations. This gives the guitar player a degree of expression not possible with signals obtained from monophonic pickups. Sometimes the sound may be digitally synthesized or modified using information obtained from the pickup signal. In such systems, inadequate or inaccurate conversion of string vibrations into pickup signals result in poor digital pitch tracking and unwanted sounds. It is therefore desirable for a polyphonic pickup to produce signals that are as accurate a representation of all aspects of the vibrating string as possible. Signal components caused by other sources, such as vibrations of adjacent strings, vibrations of other parts of the guitar, noises created by inadvertent impacts on the guitar body, fret noise, etc., are to be avoided as much as possible. Generally, piezoelectric pickups are more sensitive to such extraneous unwanted effects than magnetic pickups are. On the other hand, magnetic polyphonic pickups may suffer from magnetic cross talk between the strings. Cross talk can occur when a each transducer senses the vibration of adjacent strings in addition to the one immediately overlying the transducer in question. This may be caused by the second string's vibration affecting the magnet field at the coil of the first transducer, and may also be caused by stray magnetic flux of the second transducer affecting the readings of the first transducer's coil When a guitar string is plucked and released, a given point on the string vibrates in multiple directions in the transverse plane. The transverse plane is the plane perpendicular to the axis of the string. The path of string vibration may be, for example, a precessing ellipse in the transverse plane. Conventional magnetic polyphonic guitar pickups respond primarily to string vibrations occurring along the vertical axis, i.e., towards and away from the pickup. They also respond, but with less sensitivity, to string vibrations occurring along the horizontal or axis, i.e., in the plane defined by the strings. As a result of this cross-axis sensitivity, string vibrations in different directions induce differently scaled voltages in the sensing coil that are inseparably mixed in the output signal. This drawback of conventional magnetic pickups limits the tracking speed, pitch accuracy, and other performance characteristics of the electronic systems that interpret the signal. As a demonstrative example, string vibrations with large amplitude in a near-horizontal direction may be indistinguishable from those with small amplitude in a near-vertical direction. Conversely, the pickup may respond with different sensitivities to string vibrations of equal amplitudes in different directions.

The insufficiency of conventional guitar pickups to determine transverse string vibration in all planes has been recognized by other inventors in the prior art. An example of a multiple pole pickup for a single string is shown in U.S. Pat. No. 4,348,930 issued to Chobanian et al. on Sep. 14, 1982 entitled Transducer For Sensing String Vibrational Movement in Two Mutually Perpendicular Planes. This patent teaches separate dedicated pole pieces and coils that are sensitive to vibration in two separate and mutually perpendicular planes. This patent is directed towards the use of a first magnetically permeable pole piece with a first coil for supplying a first electrical signal and a second magnetically permeable pole piece with a second coil for supplying a second electrical signal. The design uses a first pole piece where the vibrational movement of the string in a first plane induces minimal or insignificant flux changes in the second coil, and vice versa. Thus, the vibrational movement of the string in one plane is sensed independently of, and with minimal influence over, the sensing of the vibrational movement of the string in the other mutually perpendicular plane. Thus, Chobanian describes a polyphonic magnetic guitar pickup with two sensor coils per string having their sensitive axes perpendicular to one another. It is claimed that when the string vibrates in the sensitive plane of one of the sensors, significantly greater changes result in the magnetic flux in one pole piece than in the other pole piece. However, this device does not permit resolving the direction of string vibration onto orthogonal axes, because the magnetic fields of both sensors interfere with each other at the string and at both pole pieces. Thus, the vibration of the string in any direction results in a non-negligible voltage being induced simultaneously in both coils.

With U.S. Pat. No. 4,534,258, entitled Transducer Assembly Responsive to String Movement in Intersecting Planes, Norman J. Anderson describes a magnetic pickup designed to determine all the transverse movement of the string. In this design, too, each coil is maximally sensitive to vibration of the string in a first plane and minimally sensitive to vibration of the string in a second plane that intersects the first plane. Anderson explains that these principal planes are preferably perpendicular and at −45 degree and +45 degree angles with respect to the top surface of the guitar body. The signals induced by the vibrations of all strings in one set of coils are combined into one audio channel, and signals induced by the vibration of all strings in the other set of coils are combined into the second audio channel. Thus, while the vibration planes are partly distinguished, the string signals are mixed. In addition, with the described device vibration planes are not fully separated because, when the string vibrates in one of the principal planes, the magnetic flux is modulated at the string location where the principal planes intersect, and consequently currents are induced in both coils. Due to the mutual interaction between magnetic fields surrounding the two pole pieces, the flux density cannot change at one pole piece without also changing at the other pole piece.

With U.S. Pat. No. 5,206,449 entitled Omniplanar Pickup for Musical Instruments, Richard E. D. McClish describes a similar arrangement of magnetic sensors, to achieve omniplanar sensitivity to string vibration. According to that invention the signals from two coils are combined after a phase shift is applied to one of the signals with respect to the other. A 90-degree phase shift is suggested for omniplanar sensitivity, and the possibility of other phase angles is mentioned. It should be noted that a 180-degree phase-shifted combination of the signals would be equivalent to a subtraction, and a zero-degree phase-shifted combination would be equivalent to a summation. With magnetic transducers of prior art, however, the sensor coils are in magnetic fields that are neither directly coupled nor fully independent. The flux fields are coupled by proximity and they intersect at the string, go that both sensor coils respond to string vibration in any direction, and they respond with different levels of sensitivity. Yet, the maximally sensitive axes of the two sensor coils are not parallel. This means that when the string vibrates in or near one of these principal planes of maximum sensitivity, the difference signal cannot result in cancellation. Hence, although a phase shifted combination of signals may provide a more nearly omniplanar sensitivity pattern than each sensor alone, neither the individual coil signals, nor their sum and difference signals, nor any phase-shifted combination of these signals can represent vibration components at intersecting planes. In contrast, if vibration components in orthogonal planes were obtained, as is the case with the present invention, then, optionally, an omniplanar output could be created from these signals.

What is needed, then, is a transducer for a vibratory string that is particularly directed to reducing cross talk between strings while providing two signals for each string representing the transverse string vibration along two orthogonal axes.

SUMMARY OF THE INVENTION

The present invention relates to variable reluctance type magnetic field sensors and has particular application to polyphonic guitar pickups. More specifically, the present invention relates to a polyphonic guitar pickup that, compared to those found in prior art, generates an output with substantially more information about the state of the vibrating string.

The present invention is directed towards a transducer for sensing the vibration of a string and resolving it into two orthogonal components by adding and subtracting the signals from two separate coils. This invention senses the string vibration in an orthogonal manner. The present invention is directed towards the use of two pickup coils, each with a pole piece of like-polarity, biased horizontally in opposite directions from the other, and a third pole piece of opposite polarity. Both coils are sensitive to transverse vibrations of strings in two orthogonal axes in the transverse plane.

The present system subtracts the signal of the first coil from the signal of the second coil to create a combined signal representing the transverse string vibrations in a first plane, and adds the signals of the first and the second coils to create a combined signal representing the transverse string vibrations in a second plane that is perpendicular to the first plane. A signal representing the mean position of the string in the first plane is also provided.

Another objective of the invention is a transducer that is sensitive to vibrations of the string above it, and substantially less sensitive to vibrations of adjacent strings.

In one preferred embodiment of the present invention, a transducer is provided with three sensor pole pieces and two electrical coils associated with a string. Two asymmetric pole pieces with sensor coils around them are located below the string and separated from one another along the axis of the string, and a symmetric pole piece is placed between them. The asymmetric pole pieces are designed to focus magnetic flux towards horizontally opposite sides of the string. When the string vibrates above all three sensor pole pieces, the motion of the string vibration along the horizontal axis will create currents of opposite polarity in the two coils. As the flux increases in the first coil to create a positive signal, the flux decreases in the second coil to create a negative signal. In contrast to this, the motion of the string vibration along the vertical axis will create currents of same polarity in the two coils. When the string vibrates along the vertical axis, as the flux increases in the first coil, the flux will also increase in the second coil, and vice versa for the decreasing flux. Therefore, when the signals from the two coils are added together, the resulting signal represents the vertical component of the string velocity, and the signals associated with the vibrations along the horizontal axis will cancel out each other. By inverting one of the signals, the two signals may be combined to form a subtraction of the signals. By subtracting the signals from the two coils, signals induced by string vibrations in the vertical plane will cancel each other out and the remaining signal will represent the vibrations in the horizontal axis. Thus, two separate audio channels will be provided where the first audio channel corresponds to the horizontal components of the string vibration and the second audio channel corresponds to the vertical components of the string vibration.

A second embodiment for the present application is the use of a magnetic saddle bridge for supporting the guitar string. By constructing the saddle bridge from a magnetically permeable material and utilizing this as a magnetic pole piece, the guitar strings will pass within the zone of the magnetic flux and engage the magnetic pickup saddle to cause the lines of magnetic flux to be carried in large part by the guitar string. This requires less magnetic energy from the permanent magnet, which will in turn reduce the cross talk between the magnetic pickup for a first string and the adjacent magnetic pickup elements for adjacent strings.

A still further embodiment of the present invention will combine the multiple sensor pole pieces and the magnetic saddle to create two signals for each string on an instrument. Thus, a hexophonic guitar pickup can utilize six separate dual coil elements for a six-string guitar and generate twelve separate guitar string signals in two sets. The first set of signals represents the vertical vibration of each of the six strings and the second set of signals represents the horizontal vibrations of each of the six strings.

A further refinement to the pickup of the present invention utilizes sensor pole caps to increase the sensitivity of the pickup by placing the sensor pole windings as perpendicular as possible to the flux lines. This allows for the coil to be placed in an area of high flux density with a large impact of the string position on the total flux across the coil.

The invention utilizes a three pole magnetic pickup for detecting string vibrations. This embodiment includes a first, symmetrically shaped magnetic pole piece with a first polarity and second and third asymmetrically shaped magnetic pole pieces where the second and third asymmetric pole pieces have a magnetic polarity opposite that of the first, symmetric pole piece. The first and second pole pieces form a first magnetic flux zone and a second magnetic flux zone extends between the first pole piece and the third pole piece. As the string vibrates, the rate of change in these magnetic flux zones is monitored through the use of electrical coils that are operatively positioned with the second and third pole pieces. The object or string is positioned so that movement of the object results in a corresponding change in the magnetic flux that is intercepted by the coils, and thereby induces a current in the coils.

These embodiments will be further described in the following detailed description.

DESCRIPTION OF THE PREFERRED EMBODIMENTS

Figure 1:
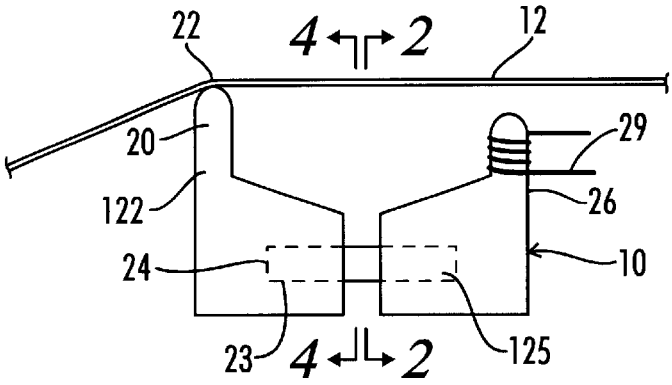
FIG. 1 is a schematic diagram of the side view of the magnetic saddle transducer pickup as utilized for the present invention.

FIG. 1 shows a side schematic view of an electrical transducer 10. The transducer 10 senses the movement of an object 12. For illustrative purposes, the electrical transducer 10 is shown in the preferred embodiment where the electrical transducer 10 is known as a guitar pickup 10, and the pickup 10 is utilized to sense the vibrations of the object 12 which is also known as a guitar string 12. The preferred embodiment is utilized in a hexaphonic pickup with separate magnetic transducers 10 for each of the six strings 12 of a guitar. This allows for twelve separate signals to be sensed, with two signals for each of the six strings. These signals may be combined, separately amplified, or otherwise utilized. It is also envisioned that any stringed item with a transducer pickup may utilize the present invention for any number of strings.

For this disclosure, the orthogonal axes will be referred to as the horizontal and vertical axes. These axes are defined by the intersection of the traverse plane and the string plane. The transverse plane is the plane that is perpendicular to the strings. The intersection between the transverse plane and the string plane will be called the horizontal axis and the axis perpendicular to the string plane will be called the vertical axis. On an electric guitar or other musical instrument where the strings are neither parallel nor co-planar, the transverse plane is defined at each string as the plane that is perpendicular to the string; the horizontal axis is defined as the line in the transverse plane that is tangent to the surface formed by the strings; and the vertical axis is defined as the axis in the transverse plane that is perpendicular to the horizontal axis.

FIG. 1 shows how the pickup 10 serves as a saddle for a bridge, and has a pickup bridge saddle portion 20 extending upwardly and supporting the guitar string 12 at support point 22. The pickup bridge portion 20, also known as a saddle 20, is made of a magnetically permeable material and forms a portion of the first magnetic pole 23 of the magnet 24 of the pickup 10. In the preferred embodiment, the first magnetic pole 23 is the north pole of the magnet 24, however, it is also noted that the north-south orientation of the poles may be reversed.

The saddle 20 shown in FIG. 1 is shown as a fixed position bridge portion 20, however, it is also envisioned that each of the individual string saddles 20 may be individually adjusted for height and horizontal position. In addition, an entire bridge may be constructed from multiple saddles 20 and the entire bridge may also be adjusted for proper positioning.

The second pole 125 of the magnet 24 is attached to an upwardly extending sensor pole piece 26 which is wrapped with electrical coils 29 and 30 on pole tips 25 and 27. The second pole 125 is the south pole of the magnet 24 in the preferred embodiment. The electrical coil 28 may utilize different designs for multiple coils on a single pole piece and other mountings and changes to the coil design as are well known in the prior art. These changes are anticipated for implementation in this design.

The guitar strings 12 do not touch the sensor pole piece 26 but are spaced a small distance therefrom. The proper distances for spacing are well known in the prior art.

As will be appreciated by those skilled in the art, the magnetic field of the pickup 10 extends from the first pole 23 to the second pole 125. The first pole 23 and the second pole 25 define a magnetic field and this magnetic field is oriented to be substantially parallel to the guitar string 12 for this embodiment. Thus, all lines of magnetic flux from the magnet 24 follow one of three paths from the north pole 23 of magnet 24 to the south pole 125 of magnet 24. The first flux path is: North pole 23 of magnet 24, pole piece 122, saddle 20, string 12, air gap 31, tip 25 of pole piece 26 and south pole 125 of magnet 24. The second flux path is: North pole 23 of magnet 24, pole piece 122, saddle 20, string 12, air gap 32, tip 27 of pole piece 26 and south pole 125 of magnet 24. The third flux path is: North pole 23 of magnet 24, pole piece 122, air outside of air gaps 31 or 32, pole piece 26, and south pole 125 of magnet 24.

The portion of the flux that follows the third path may be called the stray flux. Stray flux extends beyond the physical boundaries of the pickup. One of the objectives of this design is to minimize the percentage of the flux lines that follow the stray flux path, so that the magnetic fields from pickups for two adjacent strings have the least possible interference with each other.

A portion of the guitar strings 12 are located within the field through which these lines of magnetic flux pass. The guitar string 12 is generally constructed from metal and may be constructed from any magnetically permeable material that will affect the magnetic flux. The string 12 engages the pickup saddle 20 at point 22 and this causes the lines of magnetic flux to be carried in large part by the guitar string 12 between point 22 and the sensor pole piece 26. This allows a lower power requirement for the magnetic pickup or transducer 10. The lower power requirement reduces the cross talk between this magnetic pickup 10 and the adjacent magnetic pickup elements 10 for the adjacent strings 12

Figure 2:
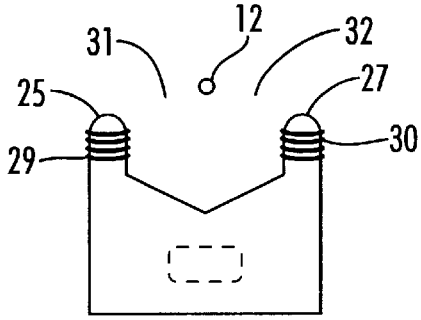
FIG. 2 is a schematic end view of the multiple sensor pole end of the electrical transducer pickup of FIG. 1 along line 2—2 as utilized in the present invention.
Figure 3:
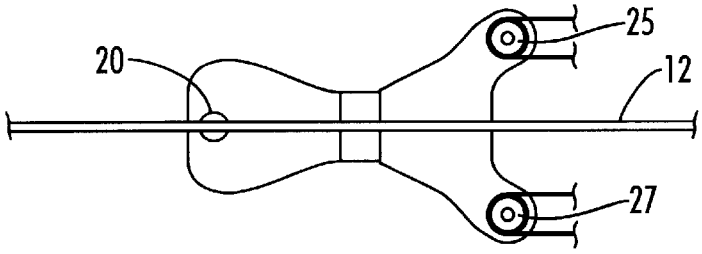
FIG. 3 is a top schematic view of a multiple channel pickup as utilized in the present invention.
Figure 4:
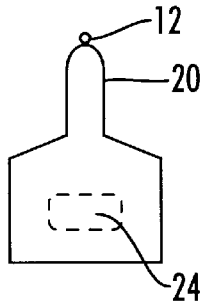
FIG. 4 is an end view of the magnetic saddle transducer of FIG. 1 along line 3—3 as utilized for the present invention.
Figure 5:
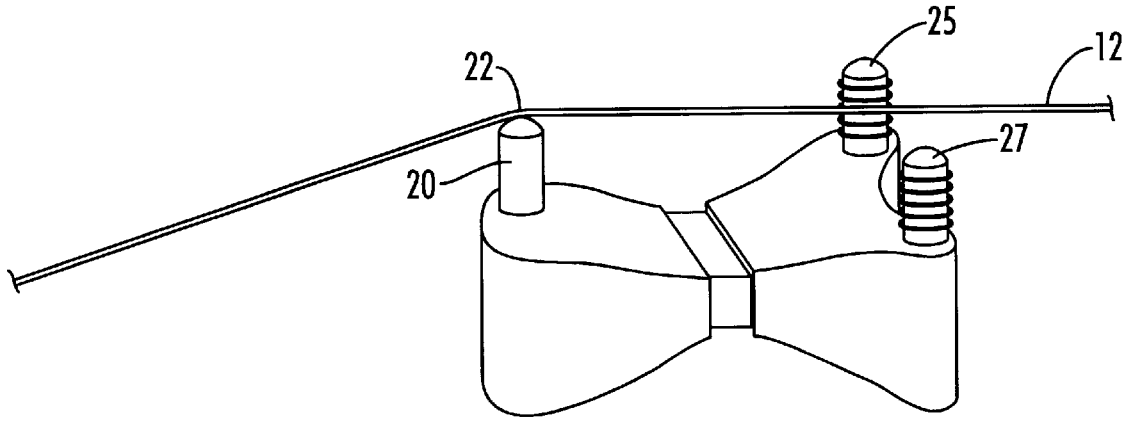
FIG. 5 is an isometric view of the electrical transducer as utilized for the present invention.

The second aspect of this invention can be appreciated with regard to FIG. 2. FIG. 2 is a cross sectional view taken along line 2—2 of FIG. 1. As seen in FIG. 2, the south pole 26 is formed from a first sensor pole piece 25 and a second sensor pole piece 27. The sensing device consists of two separate coils for this design with a first coil 29 wrapped around the first sensor pole piece 25 and a second coil 30 wrapped around the second sensor pole piece 27. While the coils 29, and 30 are shown as single coil systems, it is also envisioned that multiple coil pieces may be utilized in each location. The important characteristic of the coils 29, and 30 is to sense the changes in the magnetic field induced by vibrations or movement in the string 12, and thus, changes in the positioning, style, number of windings, and other coil characteristics may be changed as is well known in the prior art.

The guitar string 12 is illustrated in its undisturbed position in FIG. 2 as being located equidistant between the sensor pole pieces 25 and 27, and located slightly there above. The string position may be altered from this arrangement for varying the signals produced by the transducer 10, although the centralized position is utilized in the preferred embodiment. When the guitar string 12 is plucked, the two sensor pole pieces 25 and 27 are capable of detecting vertical vibrations of guitar string 12 and horizontal vibrations of guitar string 12.

It will be appreciated that a vertical vibration of guitar string 12 will affect the coils 29 and 30 of sensor pole pieces 25 and 27 equally. On the other hand, horizontal vibrations of guitar string 12 will move closer to one sensor pole piece and further away from the other, thus creating signals of opposite polarity in the coils 29 and 30. By combining the first signal of the first sensor coil 29 and the second signal of the second sensor coil 30, the horizontal components of the signals will cancel each other out. In addition, the vertical components of the signal will reinforce each other to provide a signal representing substantially the vertical component of string vibration. In contrast, the signal may be subtracted if one of the sensor signals is inverted and then the inverted signal is combined with the other signal. By subtracting, the vertical components will cancel each other out, and the horizontal components will reinforce each other to provide a signal representing substantially the horizontal component of string vibration. This allows for differing signals to be detected for vertical, as contrasted to horizontal, vibrations. Thus the design of the transducer 10 utilizes a single magnet, three pole pieces and two coils, and can be used to generate two signals, one representing vertical vibration of string 12 and the other representing horizontal vibration of string 12.

The sensor of the present invention is designed in such a way that when a string vibrates, in any direction in the transverse plane, around a nominal mean horizontal position, voltages are induced in two sensors, each sensor having "nearly the same" voltage sensitivity as the other. Due to the horizontal gradient and bi-lateral symmetry of the magnetic field, the projection of transverse string velocity on the vertical and horizontal axes is obtained as the sum and the difference, respectively, of the voltages induced in the two sensor coils. The "nearly the same" feature is a key distinction between this device and prior art devices. The prior art patents describe pickups where one coil is "substantially more sensitive" than the other, depending on plane of vibration. However their magnetic fields interfere near the string. In contrast, with the present design, although the fields are coupled, when the string vibrates in the vertical plane the difference signal totally cancels because the two coil signals are identical, in the horizontal plane the sum signal cancels because the coil signals are perfectly symmetric.

Figure 13:
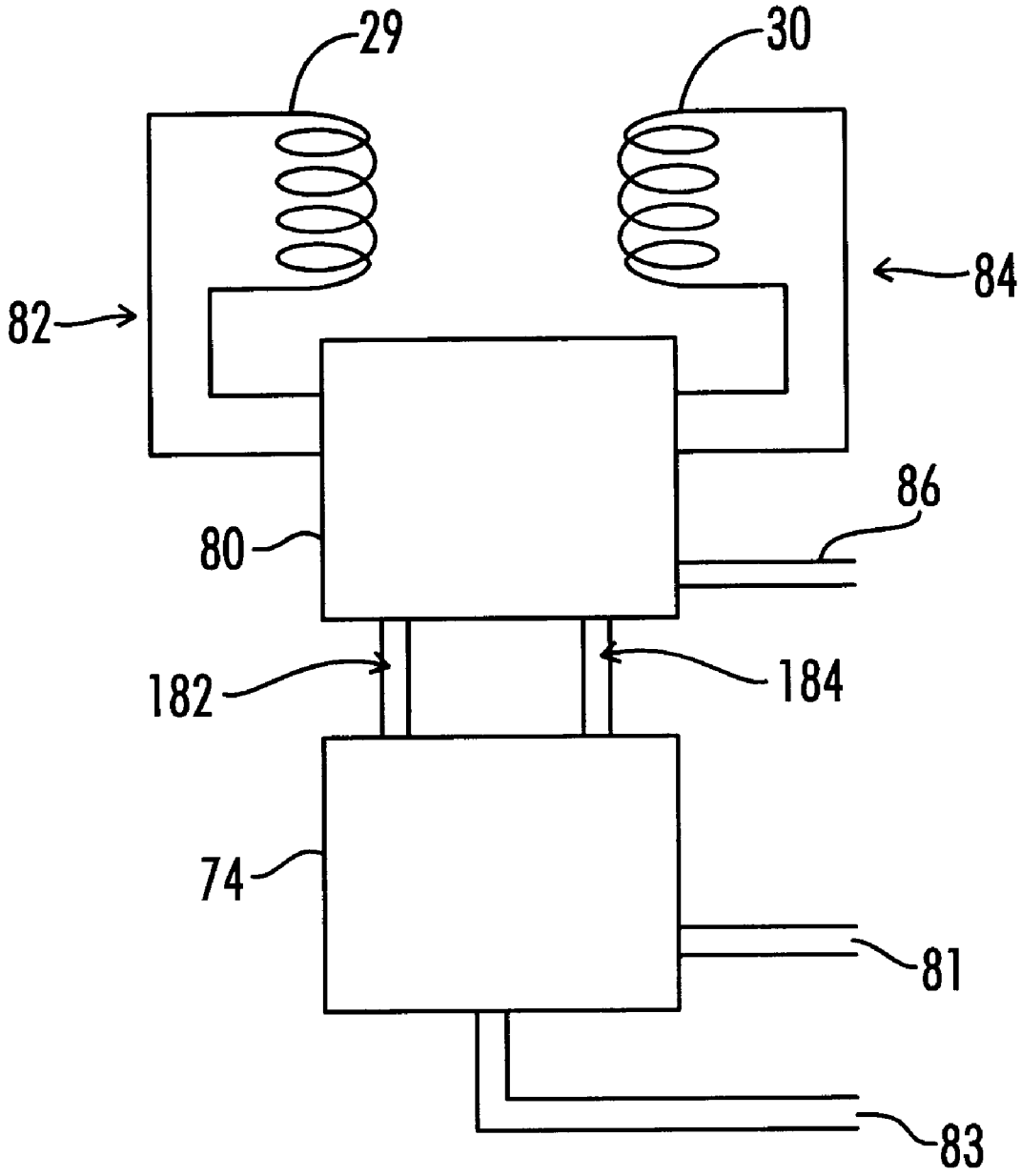
FIG. 13 is a schematic view of an equalizing scaler combined with a signal mixer.

The voltage sensitivity of one coil relative to that of the other coil does change, however, when the string's mean horizontal position is altered from its nominal position at the symmetry axis of the magnetic field, such as when the player slides the string laterally across the fret board, for example to bend the pitch of a note. This design also allows transverse string velocity components along two orthogonal axes, as well as the mean horizontal position, of each string, to be determined from the voltages induced in two sensor coils per string. As shown in FIG. 13, this is done with an electronic equalizing scaler circuit 80 that monitors root-mean-square (RMS) values of the signals induced in both coils 29 and 30. The scaler circuit 80 is calibrated such that when the string 12 vibrates about its nominal position, both coils' signal outputs 82 and 84 will be appropriately scaled to scaled coil signals 182 and 184 to allow for horizontal and vertical component separation. When the vibrating string 12 is moved laterally in the string plane, the ratio of the RMS value of the first coil's output 82 to the RMS value of the second coil's output 84 changes in proportion to the displacement of the mean horizontal position of the string 12. This variable ratio is a low-bandwidth signal that represents the mean horizontal position of the string 12. The scaling circuit 80 scales or multiplies the second coil output 84 with this low-bandwidth signal to create a scaled second coil output 184. The first coil signal output 82 may also be appropriately scaled to create the first coil scaled output 182, such that the second coil signal output 184 will match against the first scaled coil output 182. Consequently, the second coil scaled output 184 has the same RMS value as the first coil scaled output 182 regardless of mean horizontal string position, and hence, the addition and subtraction operations of the scaled outputs 182 and 184 yield the vertical and horizontal vibration components, respectively, regardless of the string's 12 mean horizontal position. The computation of RMS values and the multiplication or scaling of two signals can be accomplished by analog or digital signal processing means well known in prior art. The inclusion of such a scaling circuit 80 into the pickup system provides two functions: The system remains orthogonal, the horizontal component will cancel out in the sum and the vertical component will cancel out in the difference of the scaled signals, even when the string is horizontally displaced with respect to the sensor.

In addition to vertical and horizontal string velocity signals, a low-bandwidth third signal is generated that represents the mean horizontal displacement 86 of the vibrating string. The bandwidth of the horizontal displacement signal 86 depends on the length of the sliding time window within which the RMS values of the two coil signals are determined. This time period must be appropriately chosen to be short enough to respond to the player's dynamic control inputs but long enough to include multiple periods of the lowest frequency components of the audio signal. For a guitar, a 100–150 ms window is recommended.

Figure 6:
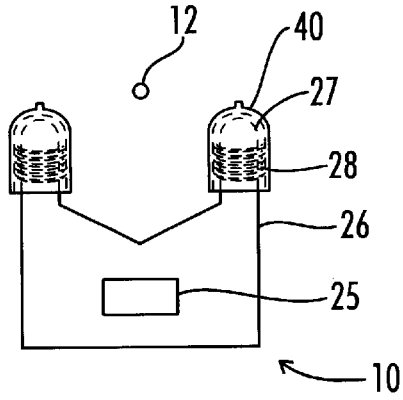
FIG. 6 is a schematic end view of the caps placed on the multiple point end of the electrical transducer pickup.
Figure 7:
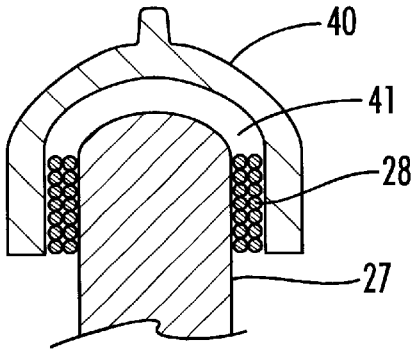
FIG. 7 is a cut away view of the cap, coil and sensor pole assembly of the present invention.
Figure 8:
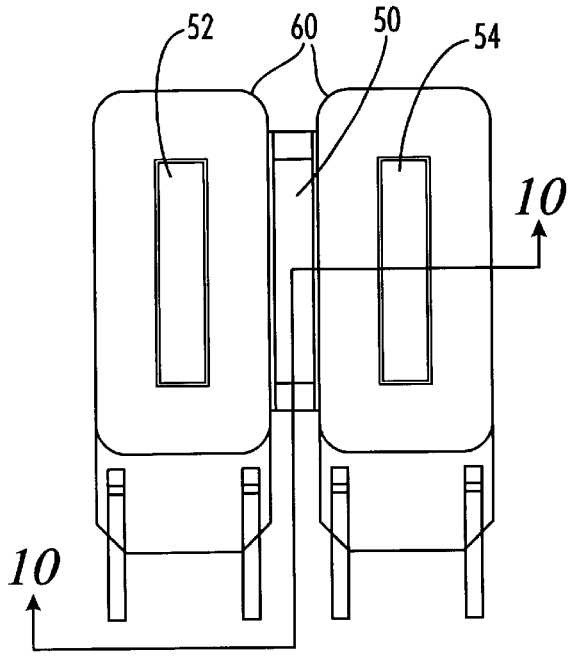
FIG. 8 is a top view of a tri-pole pickup.
Figure 9:
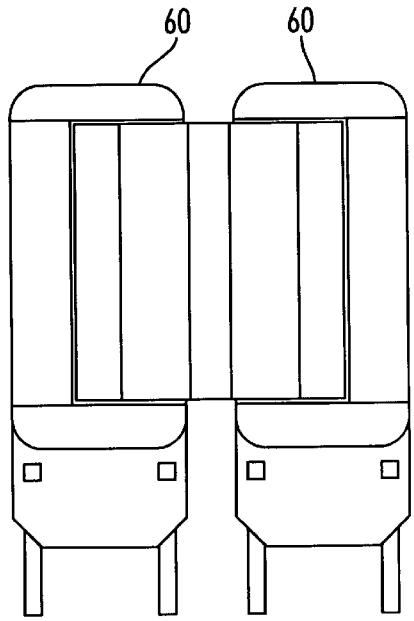
FIG. 9 is a bottom view of the tri-pole pickup of FIG. 8.

FIG. 6 of the drawings shows a schematic end view of sensor pole caps 40 placed on the sensor pole pieces 26 of the electrical transducer pickup 10 and FIG. 7 shows a cut away view of the cap 40, coil 28 and sensor pole 27 assembly of the present invention. The objective of the cap 40 is to place the coil 28 windings as perpendicular as possible to the flux lines and design the magnetic circuit such that a small change in the string 12 position will create a large change in the flux that is intercepted by the coil 28. It is best to place the coil 28 in an area of high flux density and to put the coil gap 41 where the string will have the greatest possible impact on the total flux across the gap 41. Thus, the coil 28 should be substantially perpendicular to the flux lines.

As shown in FIGS. 6 and 7, the cap 40 is not actually connected to either pole 23, or pole 125 of the magnet 24. This allows for the control of the flux lines over the coils. Beginning at the first pole, the string will pass over or contact the bridge saddle 22 which is carrying the magnetic field from the first pole 23 of the magnet 24. In the preferred embodiment, the string 12 will magnetically contact the north pole 23 of the magnet 24 through the magnetic saddle 20. As the string 12 approaches the cap 40 from the saddle piece 20, the string 12 will transfer the polarization from the bridge saddle 20 to the cap 40. Thus, the cap 40 now has the same polarization of the first pole 23. The amount of polarization on the cap 40 is dependent on the distance from the string 12 to the cap 40 and the strength of the magnetic field being carried by the string 12. Thus, as the distance between the cap 40 and the string 12 increases, the magnetic field transfer from the string 12 to the cap 40 lessens, and a corresponding signal is induced in coil 28. A further refinement may utilize ferro-fluid in the coil gap 41 to reduce the reluctance of the coil path, and a still further refinement may utilize a coating or additional shield on the outside of the cap 40 to prevent eddy currents around the cap 40. This coating may be any material of high electrical conductivity including the copper of the preferred embodiment.

FIGS. 8–11 show another embodiment of the present invention which is also known as a tri-pole electrical transducer or pickup 48. the embodiment that is shown utilizes three magnetic pole pieces. As shown by the pole placement in FIG. 8, this particular embodiment utilizes two magnetic fields for generating electrical signals. The first magnetic field is formed between the first magnetic pole 50 and the second magnetic pole 52, and the second magnetic field extends between the first magnetic pole 50 and the third magnetic pole 54. The second 52 and third 54 magnetic poles each have a like polarity, and the first magnetic pole 50 has the opposite polarity. Thus, the first 50 and second 52 poles form a first magnetic flux zone, and a second magnetic flux zone which extends between the first pole 50 and the third pole 54.

A coil assembly is placed in each magnetic flux zone to transfer the mechanical energy of the vibrating string into electrical energy. Thus, a first electrical coil 56 and a second electrical coil 58 are operatively positioned so that changes of flux within the magnetic flux zones will generate electrical currents in electrical coils 56 and 58. The string or object 12 is shown positioned in the first and second magnetic flux zones so that movement of the object 12 causes corresponding changes in the first and second flux zones. These changes induce a first current in the first coil 56 and a second current in the second coil 58.

These currents may be utilized as previously described to obtain horizontal and vertical vibration information about the object 12.

Figure 10:
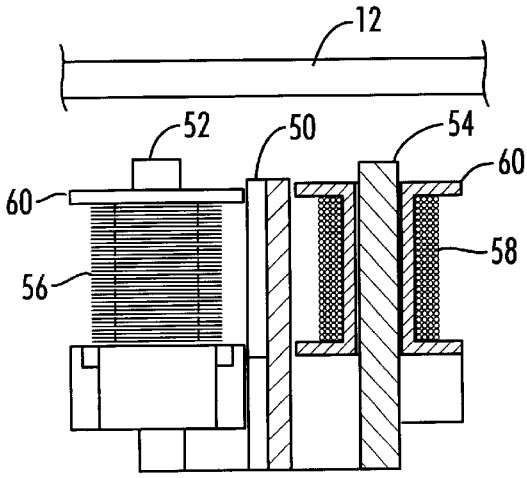
FIG. 10 is a cutaway view of the tri-pole pickup of FIG. 8 along line A—A.
Figure 11:
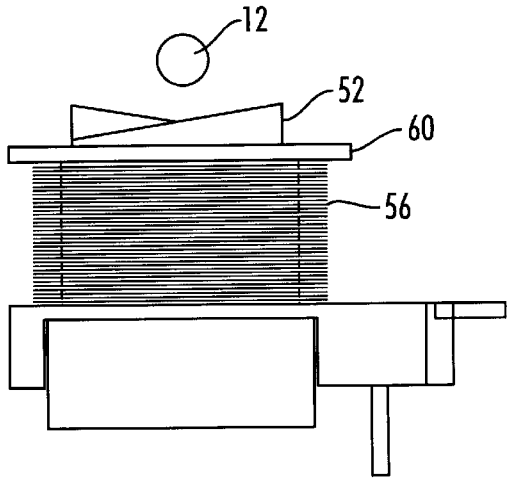
FIG. 11 is a left side view of the tri-pole pickup of FIG. 8.

As shown in FIGS. 10 and 11, the object 12 can be positioned over the first pole 50, the second pole 52 and the third pole 54. In the preferred embodiment, the object will also be positioned to perpendicularly intersect the winding axes of the coils 56 and 58. FIGS. 8–11 also show how the coils 56 and 58 may be wound onto bobbins 60 that may be placed onto the second 52 and third 54 poles. This simplifies the manufacturing of the transducers 10 as is well known in the prior art.

The individual outputs of each coil signal, are processed through a mixer. The electrical transducer 10 outputs a first and second signal which are combined in the mixer to provide mixed signals corresponding to the vertical and horizontal components of the vibration of the string 12. When the signals induced in coils 56 and 58 are used as inputs to the mixer, the mixing operation cancels out the signals induced by horizontal movement of string 12 and reinforces the signals induced by vertical movement of string 12 to provide a vertical vibration signal. The mixer can also subtract the first signal from the second signal to cancel out the signals induced by vertical components of string vibration and reinforce the signals induced by horizontal components of string vibration to provide a horizontal vibration signal. The mixer may create the difference signal by inverting one of said signals to form an inverted signal and combining the inverted signal with the remaining signal.

Figure 12:
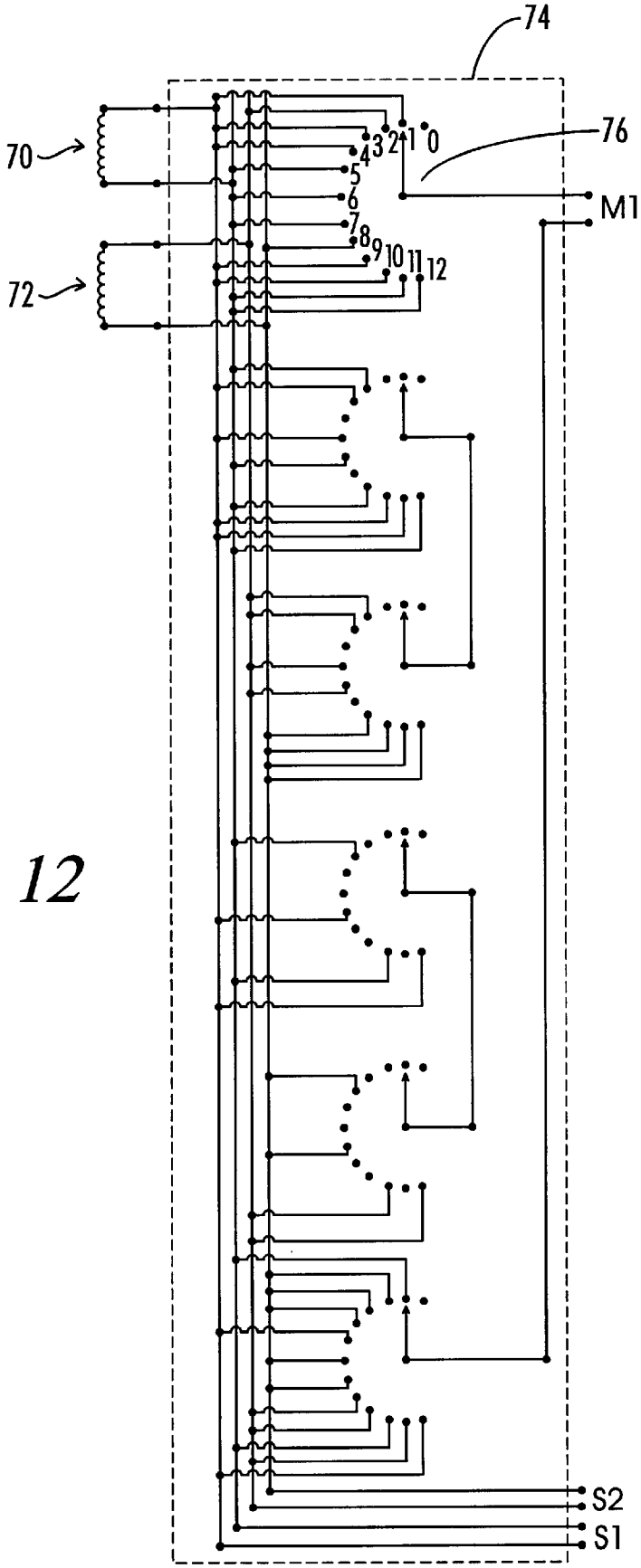
FIG. 12 is a schematic view of a signal mixer.

As shown in FIG. 12 of the drawings, the first coil 70 and the second coil 72 can be wired into a mixer 74. The mixer 74 may be any unit designed to select from the varying combinations of possible signals from the transducer 10. The mixer 74 shown in FIG. 12 is a simple analog switch type mixer, however, digital signal mixers and integrated circuit designs may be utilized for implementing or selecting from the potential combinations of the signals. In addition to the mixer design for combining the signals from the first and second coils, it is also envisioned that further improvements could be utilized for additional coils placed in operative position with the first pole of the transducer, or additional coils placed with the second or third poles.

As shown in FIG. 12, the mixer 74 selects the signal combinations for creating mixer output signals M1, S1, S2. Terminals S1 allow for a direct connection to the first coil 70 output, and terminals S2 allow for a direct connection to the second coil 72 output. The first coil 70 and the second coil 72 are also shown connected to a combination selector switch 76 style of mixer 74. The selector switch 76 is a six wafer miniature rotary style switch with an output from each wafer. These wafers are wired to provide the following combinations for output signals at terminals M1:

Position 0—No signal;

Position 1—the first coil output;

Position 2—the second coil output;

Position 3—series connection of the first coil and the second coil;

Position 4—parallel connection of the first coil and the second coil;

Position 5—the first coil inverted;

Position 6—series connection of the first coil inverted and the second coil;

Position 7—parallel connection of the first coil inverted and the second coil;

Position 8—the second coil inverted;

Position 9—series connection of the first coil and the second coil inverted;

Position 10—parallel connection of the first coil and the second coil inverted;

Position 11—series connection of the first coil inverted and the second coil inverted;

Position 12—parallel connection of the first coil inverted and the second coil inverted.

The signals from the first coil 70 and the second coil 72 may be added, subtracted, or combined in a multitude of combinations including those combinations shown herein as is well the combinations known in the prior art. It is envisioned that all of these combinations, or a selected number of combinations may be implemented by a mixer for varying the output signals.

In addition to the singular transducer and mixer described herein, multiple transducers may utilized in combination to produce a hexaphonic pickup including six separate pickup elements like those illustrated in FIGS. 1 and 2. In this manner, a six string guitar utilizing the present invention will actually generate twelve separate signals. Each string will have one signal representing the vertical vibration of the strings and one signal representing the horizontal vibration of the string. Thus a set of vertical signals and a separate set of horizontal signal may be formed. These separate signals may then be utilized individually, or combined in different manners to produce different output combinations. Thus, one output signal could represent the vertical vibrations on the set of strings. A different output combination could be utilized for the horizontal outputs of the strings. Yet a third group could selectively use vertical outputs from some strings and horizontal outputs from others. In addition, the vertical signal and horizontal signal from an individual transducer may be combined to form another signal.

Thus, although there have been described particular embodiments of the present invention of a new and useful Electric Guitar Pickup with Magnetic Bridge and Multiple Pickup Pieces, it is not intended that such references be construed as limitations upon the scope of this invention except as set forth in the following claims.

What is claimed is:

1. An electrical transducer apparatus for sensing movement of a magnetically permeable string and generating an electrical signal, comprising:

a first pole piece with a first magnetic polarity, a second pole piece with a second opposite polarity defining a magnetic field with the first pole piece, an electrical coil positioned for sensing changes in the magnetic field induced by movement of the magnetically permeable string, wherein the coil converts the sensed changes in the magnetic field to the corresponding electrical signal; and wherein said string contacts the first pole piece.

2. An electrical transducer apparatus for sensing movement in a magnetically permeable string, comprising:

a magnetic field with a first pole piece, a second pole piece and a third pole piece, wherein a first magnetic flux zone extends between said first pole piece and said second pole piece, and a second magnetic flux zone extends between said first pole piece and said third pole piece;

electrical coils positioned with said second and third pole pieces for sensing changes in the magnetic field induced by movement of the magnetically permeable string; and said object positioned such that movement of said object induces a corresponding change in said magnetic flux zones and thereby induces currents in said coils.

3. The electrical transducer apparatus of claim 2, wherein said first pole piece is adjustable for height and horizontal position together with or independently from said second and third pole pieces and magnet.

4. An electrical transducer apparatus for sensing the movement of an string, comprising:

a magnet with a first pole and a second pole, said second pole including a plurality of pole pieces to create a plurality of magnetic flux zones extending between said first pole and said second pole;

said string positioned such that movement of said string induces corresponding changes in said magnetic flux zones; and a plurality of electrical coils, wherein each electrical coil is associated with a pole piece, said pole pieces and coils positioned such that flux changes in said magnetic flux zones induce electrical currents in said coils.

5. The electrical transducer apparatus of claim 4, wherein said string is positioned between and above at least two of said plurality of pole pieces so that during movement said string does not contact said pole pieces.

6. The electrical transducer apparatus of claim 5, wherein said plurality of pole pieces includes a second pole piece and a third pole piece; and said string is equi-distantly positioned between said second pole piece and said third pole piece.

7. The electrical transducer apparatus of claim 4, wherein said plurality of pole pieces on the second pole includes a second pole piece and a third pole piece; and said electrical coils include a first coil operatively positioned with said second pole piece for producing a first signal and a second coil operatively positioned with said third pole piece for producing a second signal.

8. The electrical transducer of claim 7, wherein the first coil is wrapped around the second pole piece and said second coil is wrapped around the third pole piece.

9. The electrical transducer apparatus of claim 7, wherein said string is equi-distantly positioned between said second pole piece and said third pole piece.

10. The electrical transducer of claim 9, further comprising a mixer for combining the first coil signal and the second coil signal to cancel out the signal components that are induced in response to horizontal components of string movement and reinforce the signal components that are induced in response to vertical components of string movement to provide a vertical vibration signal.

11. The electrical transducer of claim 9, further comprising a mixer for subtracting the first coil signal from the second coil signal to cancel out the signal components that are induced in response to vertical components of string movement and reinforce the signal components that are induced in response to horizontal components of the signals to provide a horizontal vibration signal.

12. The electrical transducer of claim 11, wherein said mixer performs the said subtraction operation by inverting one of said signals to form an inverted signal and combining the inverted signal with the remaining signal.

13. A method for increasing the sensitivity of an electrical transducer, comprising:

providing a magnetically permeable string, an electrical coil, a cap, and a magnetic field with a first pole and a second pole;

locating the magnetically permeable string within said magnetic field such that vibrations of the string induce corresponding changes in said magnetic field;

placing said coil in a position such that changes in said magnetic field induce a current in said coil; and positioning said coil between said cap and said second pole to control the magnetic field across said coil.

14. The method of claim 13, further comprising:

engaging said string with said first pole.

15. A transducer pickup, comprising:

a magnet with a first pole, a second pole, and a magnetic flux zone extending between said first pole and said second pole;

an electrical coil operatively positioned with said second pole;

said string positioned such that movement of said string induces a corresponding change in said magnetic flux zone and thereby induces a current in said coil; and a pole cap between said string and said pole piece wherein said cap directs said flux zone to be substantially perpendicular to the windings of said coil.

16. The electrical transducer of claim 15, further comprising:

ferro-fluid between said cap and said sensor pole piece.

17. The electrical transducer of claim 15, further comprising:

an electrically conducting coating on said cap to reduce eddy current losses.

18. An electrical transducer utilizing a single magnetic field with both a first sensor means to generate a first signal representing a horizontal vibration of strings and a second sensor means to generate a second signal representing a vertical vibration of said strings.

19. An electrical guitar pickup apparatus for sensing vibrations in a magnetically permeable guitar string, comprising:

a first pole of a magnetic field including a magnetically conductive pickup bridge supporting said guitar string;

a second pole of said magnetic field including a second pole piece spaced from said guitar string, wherein said string is located within said magnetic field formed between said first pole and said second pole; and a first pickup coil positioned with said second pole piece such that changes in said magnetic field induce a current in said coil, wherein said string is positioned such that movement of said string affects said magnetic field and thereby induce a current in said first coil.

20. The electrical guitar pickup apparatus of claim 19, wherein said second pole includes a third pole piece with an operatively positioned second pickup coil, wherein said string is positioned between said first pole piece and said third pole piece so that horizontal vibrations of the string induce currents of opposite polarity in said first and second coil and vertical vibrations of the string induce currents of like polarity in said first and second coil.

21. The electrical guitar pickup apparatus of claim 20, further comprising:

a mixer for adding said first and second signal to obtain a signal representative of the vibrations perpendicular to the string plane, and subtracting said first and second signals to obtain a signal representative of the vibrations in the string plane.

22. The electrical guitar pickup apparatus of claim 21, further comprising:

field concentrator caps operatively positioned between said string and said coil to concentrate the magnetic flux lines across said coil.

23. A tri-pole electrical transducer apparatus for sensing movement in a magnetically permeable string, comprising:

a first magnetic pole with a first polarity;

a second and third magnetic poles each having a second polarity;

a first magnetic flux zone extending between said first pole and said second pole;

a second magnetic flux zone extending between said first pole and said third pole;

a first electrical coil positioned with at least one of said poles such that changes in the magnetic flux zone associated with the at least one of said poles induces a current in said coil; and said string positioned such that movement of said string induces a corresponding change in at least one of said zones and thereby induces a first current in said first coil.

24. The electrical transducer apparatus of claim 23, wherein said first electrical coil is operatively positioned with said second pole.

25. The electrical transducer apparatus of claim 23, further comprising:

a second electrical coil operatively positioned with the third pole;

said string positioned such that movement of said string induces a corresponding change in said second magnetic flux zone and thereby induces a second current in said second coil.

26. The electrical transducer apparatus of claim 23, wherein said string is positioned over said first, second and third poles.

* * * * *

UNITED STATES PATENT AND TRADEMARK OFFICE

CERTIFICATE OF CORRECTION

PATENT NO. : 6,392,137 B1
DATED : May 21, 2002
INVENTOR(S) : Osman K. Isvan

It is certified that error appears in the above-identified patent and that said Letters Patent is hereby corrected as shown below:

Column 3,
Line 64, replace “go” with -- so --.

Column 12,
Line 37, replace “object” with -- string -- at both places.

Signed and Sealed this

Twenty-ninth Day of October, 2002

*Attest:*

*Attesting Officer*

JAMES E. ROGAN
*Director of the United States Patent and Trademark Office*